US005950840A

United States Patent [19]

Thoma

[11] Patent Number: 5,950,840

[45] Date of Patent: Sep. 14, 1999

[54] BAR SCREEN SYSTEM WITH ATTACHED SCREENS

[75] Inventor: Eduard J. Thoma, Powell River, Canada

[73] Assignee: Beloit Technologies, Inc., Wilmington, Del.

[21] Appl. No.: 09/002,542

[22] Filed: Jan. 2, 1998

[51] Int. Cl.[6] ..... B07B 1/28

[52] U.S. Cl. ..... 209/314; 209/315; 209/395; 209/674

[58] Field of Search ..... 209/311, 313, 209/314, 315, 317, 393, 395, 396, 674

[56] References Cited

U.S. PATENT DOCUMENTS

| | | | |
|---|---|---|---|
| 1,606,301 | 11/1926 | Jones . | |
| 2,443,176 | 6/1948 | Banning | 209/395 |
| 4,569,446 | 2/1986 | Kelley | 209/674 X |
| 5,219,078 | 6/1993 | Hadden | 209/314 X |
| 5,284,251 | 2/1994 | Marrs et al. . | |
| 5,305,891 | 4/1994 | Bielagus | 209/396 |
| 5,392,930 | 2/1995 | Jones | 209/674 |
| 5,392,931 | 2/1995 | Bielagus | 209/674 |
| 5,476,179 | 12/1995 | Jones et al. | 209/674 |
| 5,560,496 | 10/1996 | Lynn | 209/395 |

FOREIGN PATENT DOCUMENTS

| | | | |
|---|---|---|---|
| 259-963 | 3/1987 | European Pat. Off. . | |
| 2567776 | 7/1984 | France . | |
| 3601671 | 7/1987 | Germany | 209/314 |
| 5-192642 | 8/1993 | Japan . | |
| 165341 | 8/1991 | Taiwan . | |
| 193911 | 11/1992 | Taiwan . | |
| 102423 | 1/1999 | Taiwan . | |
| 1360821 | 11/1985 | U.S.S.R. . | |
| PCT/SE86/ 00585 | 7/1987 | WIPO . | |
| WO94/02261 | 7/1993 | WIPO . | |
| WO95/01918 | 7/1994 | WIPO . | |
| 94 26427 | 11/1994 | WIPO | 209/314 |

OTHER PUBLICATIONS

"DynaGage™ Bar Screen . . . high performance chip thickness screening." Radar Companies.

*Primary Examiner*—Tuan N. Nguyen
*Attorney, Agent, or Firm*—Lathrop & Clark LLP; Raymond W. Campbell

[57] ABSTRACT

A bar screen is combined with a wire or punch screen which is suspended beneath the screen deck from a pair of oscillating bar support beams so that a single bar screen, screen combination, may not only size materials for thickness but remove small particulate material from the chips or materials which pass through the screen deck of the bar screen.

4 Claims, 2 Drawing Sheets

BAR SCREEN SYSTEM WITH ATTACHED SCREENS

FIELD OF THE INVENTION

The present invention relates to apparatus for screening particulate matter, such as wood chips, and relates to bar screen apparatus in particular.

BACKGROUND OF THE INVENTION

Bar screens have proven particularly valuable in sorting materials which have unequal dimensions. Wire or punched screens are typically used to sort materials of a granular nature in which all three dimensions are approximately equal. However, many classes of objects, including two of particular commercial interest, wood chips and municipal or industrial trash, are not readily amenable to separation by conventional screening processes.

In the manufacture of paper, logs are reduced to wood chips by chipping mechanisms, and the chips are cooked with chemicals at elevated pressures and temperatures to remove lignin. The chipping mechanisms produce chips which vary considerably in size and shape. For the cooking process, which is known as digesting, it is desirable that the chips supplied have a uniform thickness in order to achieve optimal yield and quality. Ideally, the supplied chips will allow production of a pulp which contains a low percentage of undigested and/or overtreated fibers. Thus, a means is needed to separate chips on the basis of thickness rather than any other dimension. Bar screens have proven particularly adept at separating materials based on a single dimension such as thickness.

Bar screens consist of two sets of generally rectangular bars which are joined together in an array of racks. The two sets of bars are interleaved to form a screening bed. The bed consists of the elongated, rectangular bars and the narrow, rectangular spaces between the bars. Material to be sorted is introduced to the surface of the bed and the bars are caused to oscillate so that when one set of bars is going up, the other set is going down. This oscillatory motion tends to tip wood chips or other relatively small planar objects on edge so that those of a given thickness may slide through the gaps between the bars.

Wood chips not only must be sized but must be cleaned of foreign matter. Because the wood chips are manufactured from logs, they typically are contaminated with sand and dirt. Wood chips are often stored outside and on occasion a lot of chips become heavily contaminated with dirt and sawdust which can adversely affect the quality of the pulp formed from the chips if the contaminants are not removed.

What is needed is a bar screen which not only sizes wood chips for thickness but removes small particulate material from the chips.

SUMMARY OF THE INVENTION

Two or more bar screens are combined with a wire or punch screen which is suspended beneath the screen deck from one pair of oscillating bar support beams so that a single bar screen, screen combination, may not only size materials for thickness, but remove small particulate material from the chips which pass through the screen deck of the bar screen. A series of bar screens is arranged so that chips which do not pass through the first bar screen pass onto the deck of a second bar screen. Similarly the chips which do not pass through the first bar screen are past onto the deck of a third bar screen. The majority of the chips and almost all the fines pass through the first bar screen deck. The screen mounted below the first bar screen deck can become overloaded. A diverter gate is positioned to correct part of the stream of chips directly onto a second screen supported below the second bar screen. The second screen is positioned to receive all the chips which are processed by the first screen. A third screen positioned beneath a third bar screen deck receives the chips from the second screen. In this way the fines and any sand or other particulars are removed from the wood chips. Wood chips which pass through the second and third bar screens are directed onto a plate positioned beneath the second and third bar screen. The plates direct the chips to the accepts stream.

It is a feature of the present invention to provide a bar screen system which can remove dirt and sand from a stream of wood chips.

It is a further feature of the present invention to provide a bar screen system which can process wood chips more efficiently.

It is yet a further feature of the present invention to provide a bar screen system which can be adjusted to handle chips with greater or lesser amounts of contaminants.

Further objects, features, and advantages of the invention will be apparent from the following detailed description when taken in conjunction with the accompanying drawings.

DESCRIPTION OF THE PREFERRED EMBODIMENTS

Figure 1:
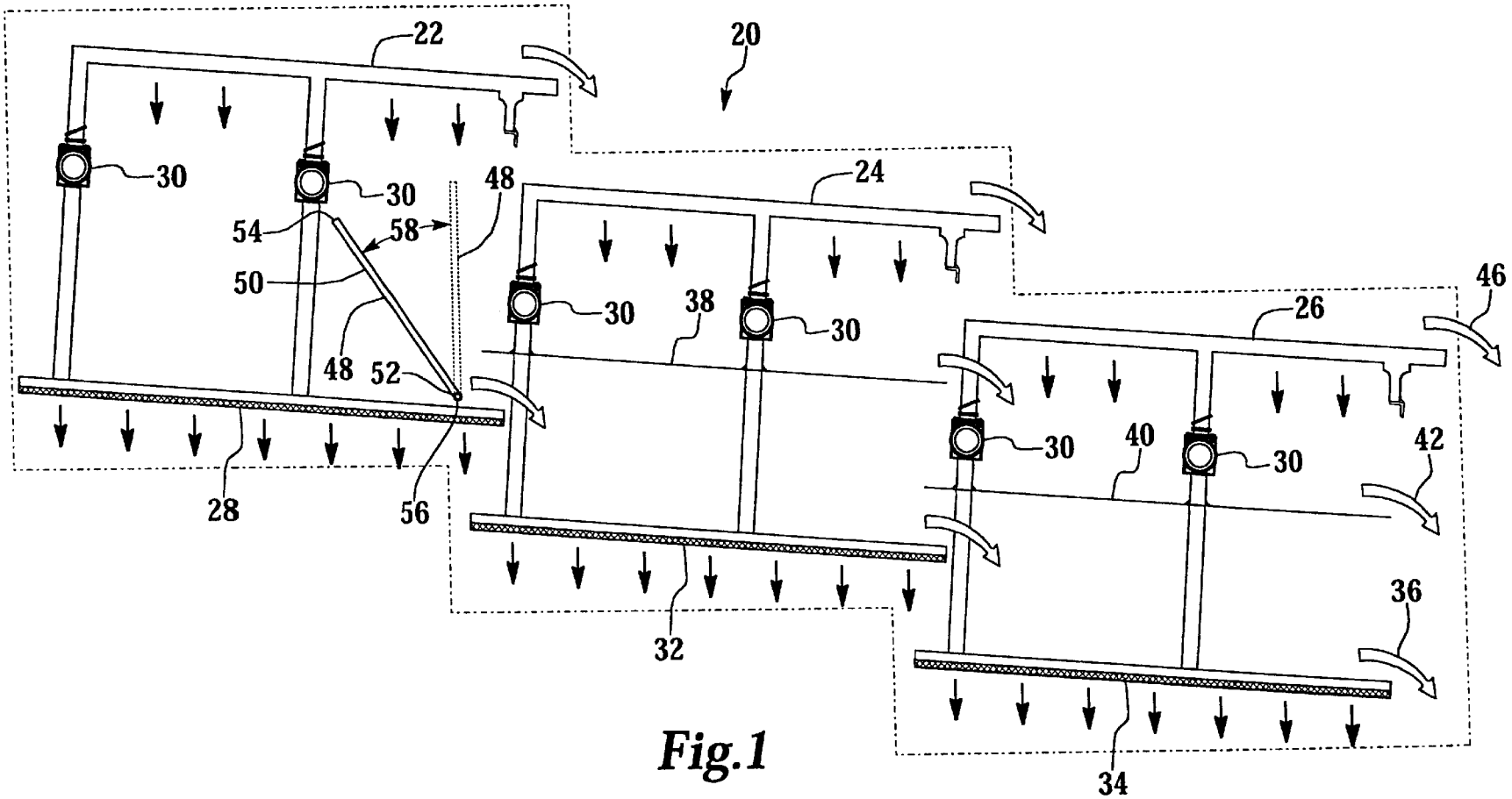
FIG. 1 is a somewhat schematic, side-elevational view of a bar screen cascade employing secondary screens.
Figure 2:
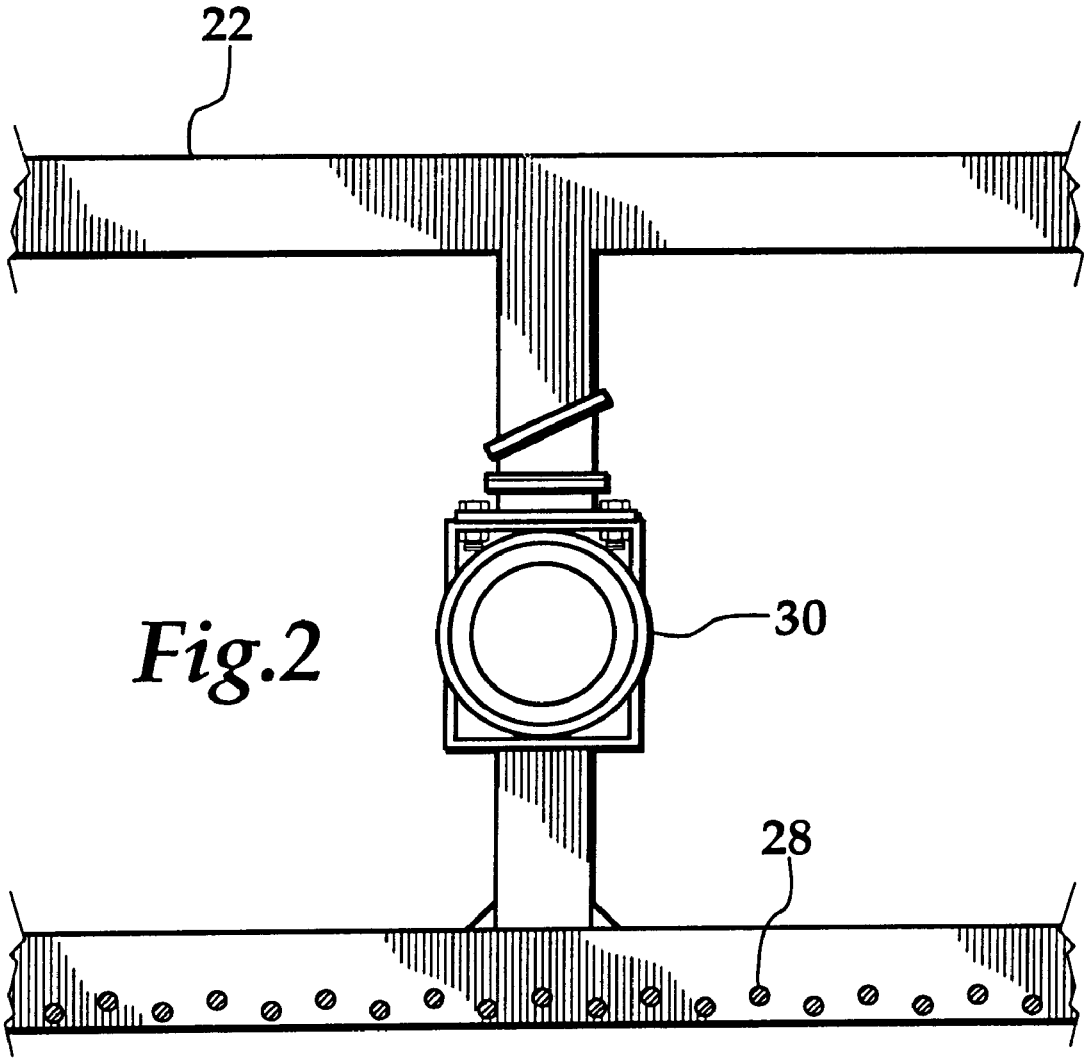
FIG. 2 is an enlarged, cross-sectional view of the screen support shown in FIG. 1.

Referring more particularly to FIGS. 1–2 wherein like numbers refer to similar parts, a bar screen system 20 is shown in FIG. 1.

Bar screens, for example U.S. Pat. No. 5,392,931 which is incorporated herein by reference, may be employed singularly, but are often joined together in tiers to accomplish a particular sorting job. The bar screen system 20 employs three bar screens 22, 24, and 26 which are shown schematically in FIG. 1. The first bar screen 22 has a conventional wire or punched plate screen 28 which is suspended beneath the bar support beams 30 of one of the screen racks of a bar screen 22. An enlargement of the bar screen 22 is shown in FIG. 2.

The bar screen system 22 is particularly adapted to deal with the sorting of wood chips as part of the papermaking process. Wood chips enter the first bar screen 22 where a certain proportion of acceptable chips pass through the screen together with almost all of the dirt and fines which normally accompany wood chips as they are produced from raw logs. The accepts and dirt fines which fall through the first screen deck 22 are processed on the underlying wire or punch screen 28. The dirt and fines which fall through the wire screen 28 are then discarded. However, separating the chips from the dirt and fines requires considerable screening time.

Therefore, the accept chips on the wire screen 28 pass to secondary wire screen 32 and a tertiary wire screen 34 where the chips finally leave the deck as accepts indicated by arrow 36. The accept chips that pass through the second bar screen 24 are essentially clean and require no further screening and are therefore conveyed on a plate 38 which feeds plate 40 which delivers an accept stream of chips 42. Accept chips which pass through the third bar screen 26 fall onto the plate 40 and join the accept chips from the second bar screen 24 and form the accept stream 42. Finally those chips which have not passed through any of the bar screens leave the third bar screen 26 as a reject stream 46.

Thus, the bar screening system 20 separates a stream of chips into oversized chips and accept chips and removes the dirt and wood particles having no significant fiber content.

At times the wood chips being processed can contain a large quality of sawdust or other material which must be removed by screening. Wood chips are often stacked outside for long periods of time, and wind can concentrate the fines such as sawdust so that as the chips are processed, the amount of fines to be removed may increase dramatically from time to time.

A large load of fines can overload the capabilities of the first screen 28. If the screen 28 is overloaded its effectiveness is decreased. A diverter gate 48 shown in FIG. 1 is positioned beneath the first bar screen 22. The gate consists of a plate 50 which is mounted to a hinge 52. The plate has a movable upper edge 54 and a lower edge 56 which is hingedly mounted. The plate 50 is movable as shown by arrow 58 to intercept a portion of the chips passing through the first bar screen 22.

By intercepting a portion of the chip, the plate diverts the intercepted chips onto the second screen 32 thereby offloading the quantity of chips falling on the first screen 28 thus permitting clogging of the screen. The plate 50 is made fixedly adjustable by any conventional means and can be adjusted on a real-time basis by an operator who is observing the loading of the first screen.

It is understood that the invention is not limited to the particular construction and arrangement of parts herein illustrated and described, but embraces such modified forms thereof as come within the scope of the following claims.

We claim:

1. A screening apparatus comprising:

a first bar screen having a first screening deck having a plurality of parallel screening bars;

a second bar screen down stream of the first bar screen and positioned to receive the discharge of the first bar screen;

a first foraminous screen positioned beneath the first bar screen and mounted for oscillatory motion with the first bar screen, wherein accept material, fines and dirt pass through the first bar screen and are received on the first foraminous screen, and wherein fines and dirt pass through the first foraminous screen and are rejected; and a first tray positioned beneath the second bar screen, such that accept material which passes through the second bar screen is received on the tray and discharged in an accept flow which joins the accepts received on the first foraminous screen.

2. The screening apparatus of claim 1 further comprising:

a third bar screen downstream of the second bar screen and positioned to receive the discharge of the second bar screen; and a second tray positioned beneath the third bar screen to receive accept material which passes through the third bar screen as well as material discharged by the first tray.

3. The screening apparatus of claim 1 further comprising:

a second foraminous screen positioned beneath the first tray to receive material discharged from the first foraminous screen; and a third foraminous screen positioned beneath the third bar screen to receive the material discharged from the second foraminous screen.

4. The screening apparatus of claim 3 further comprising:

a plate positioned between the first bar screen and the first foraminous screen the plate having an upper movable edge and a lower edge which is hingedly mounted, so that motion of the plate allows diversion of some of the chips passing through the first bar screen onto the second foraminous screen.

* * * * *